US008145119B2

(12) United States Patent
Cornwell

(10) Patent No.: US 8,145,119 B2
(45) Date of Patent: Mar. 27, 2012

(54) METHOD OF JAMMING

(75) Inventor: James Cornwell, Ruther Glen, VA (US)

(73) Assignee: Kaonetics Technologies, Inc., Inyokern, CA (US)

( * ) Notice: Subject to any disclaimer, the term of this patent is extended or adjusted under 35 U.S.C. 154(b) by 1084 days.

(21) Appl. No.: 11/937,119

(22) Filed: Nov. 8, 2007

(65) Prior Publication Data

US 2012/0045984 A1 Feb. 23, 2012

Related U.S. Application Data

(63) Continuation-in-part of application No. 11/778,316, filed on Jul. 16, 2007, now abandoned.

(60) Provisional application No. 60/830,670, filed on Jul. 14, 2006.

(51) Int. Cl.
*H04K 3/00* (2006.01)

(52) U.S. Cl. ..... 455/1; 455/296

(58) Field of Classification Search ..... None
See application file for complete search history.

(56) References Cited

U.S. PATENT DOCUMENTS

| | | | | |
|---|---|---|---|---|
| 7,697,885 | B2 * | 4/2010 | Stoddard | 455/1 |
| 2005/0168375 | A1 * | 8/2005 | Halladay et al. | 342/14 |
| 2005/0212673 | A1 * | 9/2005 | Forster | 340/572.7 |
| 2006/0060074 | A1 * | 3/2006 | Ham et al. | 89/1.11 |
| 2006/0105701 | A1 * | 5/2006 | Cornwell | 455/1 |
| 2006/0164282 | A1 * | 7/2006 | Duff et al. | 342/14 |

* cited by examiner

*Primary Examiner* — Cassandra Cox
(74) *Attorney, Agent, or Firm* — Stroock & Stroock & Lavan, LLP

(57) ABSTRACT

A jamming system includes at least three jamming units. Each jamming unit is separately positionable and pointable. Each jamming unit covers different frequency bands. A method of using the jamming system includes moving a first jamming unit relative to a second jamming unit, and yawing a first jamming unit relative to an orientation of a third jamming unit.

20 Claims, 10 Drawing Sheets

METHOD OF JAMMING

RELATED APPLICATIONS

This application is a continuation-in-part of U.S. patent application Ser. No. 11/778,316 filed Jul. 16, 2007 now abandoned, which claims the benefit of the filing date of U.S. Provisional Application Ser. No. 60/830,670 filed Jul. 14, 2006.

FIELD OF THE INVENTION

The present invention relates to electronic countermeasure jamming systems that are capable of interrupting radio links from triggering devices used in connection with improvised explosive devices. In particular, the invention related to method of using a jamming system that includes distributed jamming units that are free to translate and yaw with respect to one another.

DESCRIPTION OF RELATED ART

Known countermeasure systems have diverse broadband radio signal generators that are fed into a relatively simple antenna. The antenna attempts to have omni-directional coverage. The simplest antenna is a half dipole oriented vertically at the center of the area to be protected by jamming. The problem with such antennas is that they do not have spherical coverage patterns for truly omni coverage. Coverage of such a simple antenna appears shaped like a donut with gaps in coverage above and below the plane of the donut because the simple dipole cannot operate as both an end fire antenna and an omni antenna. More complex antennas may add coverage in end fire directions but generate interference patterns that leave gaps in coverage.

In an environment where small improvised explosive devices (TED) are placed in airplanes, busses or trains and triggered by radio links distant from the IED, it becomes more important to successfully jam the radio link without gaps in jamming system coverage.

Known omni directional systems radiate to provide 360 degree coverage on a plane with elevations plus or minus of the plane. Very few truly omni directional antenna systems are known to create coverage in three dimensions on a unit sphere. Difficulties are encountered that include, for example, the feed point through the sphere causes distortion of the radiation pattern, metal structures near the antenna cause reflections that distort the radiation pattern, and the individual radiating element of an antenna inherently does not produce a spherical radiation pattern. In addition, providing a spherical radiation pattern over a broad band of frequencies can be extremely difficult. Antenna structures intended to shape the radiation pattern at one frequency can cause distortion in the radiation pattern at another frequency.

The inventor's published International Application, WO 2006/086658 A1, titled "Antenna System", filed Feb. 13, 2006, describes novel antenna systems and is incorporated by reference herein.

SUMMARY OF THE INVENTION

A jamming system includes at least three jamming units. Each jamming unit is separately positionable and pointable. Each jamming unit covers different frequency bands. A method of using the jamming system includes moving a first jamming unit relative to a second jamming unit, and yawing a first jamming unit relative to an orientation of a third jamming unit.

BRIEF DESCRIPTION OF DRAWINGS

The invention will be described in detail in the following description of preferred embodiments with reference to the following figures.

DETAILED DESCRIPTION OF PREFERRED EMBODIMENTS

A novel method of using a jamming system will be described below with respect to a distributed jamming system of a type repackaged from a central integrated jamming system. First, the central integrated jamming system will be described, followed by a description of the repackaging of the central integrated jamming system into the distributed jamming system, and then the method of using the distributed jamming system.

Figure 2:
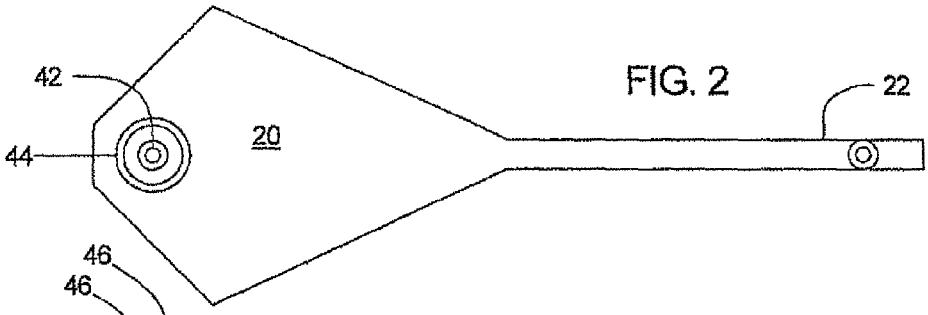
FIGS. 2 and 3 are plan views of the antenna of FIG. 1 from the obverse and reverse sides, respectively.
Figure 1:
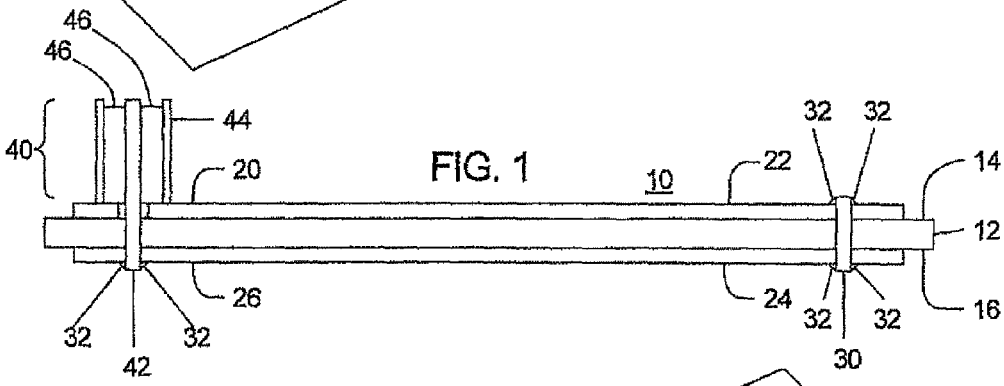
FIG. 1 is a sectional view of an antenna as might be used in an embodiment of an antenna system.
Figure 3:
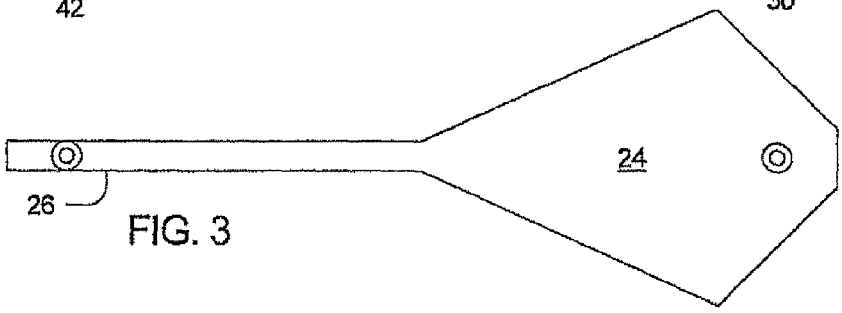

In FIGS. 1-3, an antenna 10 of a central integrated jamming system includes a planar shaped insulating substrate 12 extending in a principal plane of the antenna. Insulating substrate 12 has an obverse side 24 and a reverse side 26. The antenna 10 further includes a first radiating element 20 and a connected first conductor 22 disposed on the obverse side 14 and also includes a second radiating element 24 and a connected second conductor 26 disposed on the reverse side 16. The antenna 10 further includes a coupling conductor 30 that couples the second radiating element 24 and the first conductor 22. The antenna 10 further includes a coupler 40 having a first signal conductor 42 and a second signal conductor 44. The first signal conductor 42 is coupled to the second conductor 26, and the second signal conductor 44 is coupled to the first radiating element 20.

In operation and as depicted in FIGS. 1-3, applied currents flow from signal conductor 42 through conductor 26, through radiating element 24, through coupling conductor 30, through conductor 22, through radiating element 20 to conductor 44. When the currents are RF signal currents, at a broad bandwidth about certain frequencies, radiating elements 20 and 24 tend to resonate and operate as an antenna. The radiation that emanates from a radiating element tends to emanate from the edge of the element (e.g., the edge of the etched copper, generally flat, shape).

Antenna 10 has a shape similar to a "bow tie" antenna, and it functions as a broad band antenna. The two halves of the "bow tie" are preferably disposed on opposite sides of the insulating substrate 12, but may, in other variations, be formed on the same side. Antenna 10 is preferably fed from an end point instead of a center point as is common with "bow tie" style antennas. However, in other variations, antenna 10 may be fed from other point, such as the center. In one variation of this antenna, the entire antenna is formed from a double sided copper clad epoxy-glass printed wiring board. In such case, conductor 30 is typically a plated through hole, but may be a rivet or pin held in place by solder filets 32 as depicted in FIGS. 1-3. Other manufactures of the same structure are equivalent. The coupler 40 may be an SMC connector, a BNC connector or other connector suitable at RF frequencies. Typically, the coupler 40 will have insulating dielectric material between conductor 42 and conductor 44.

Figure 4:
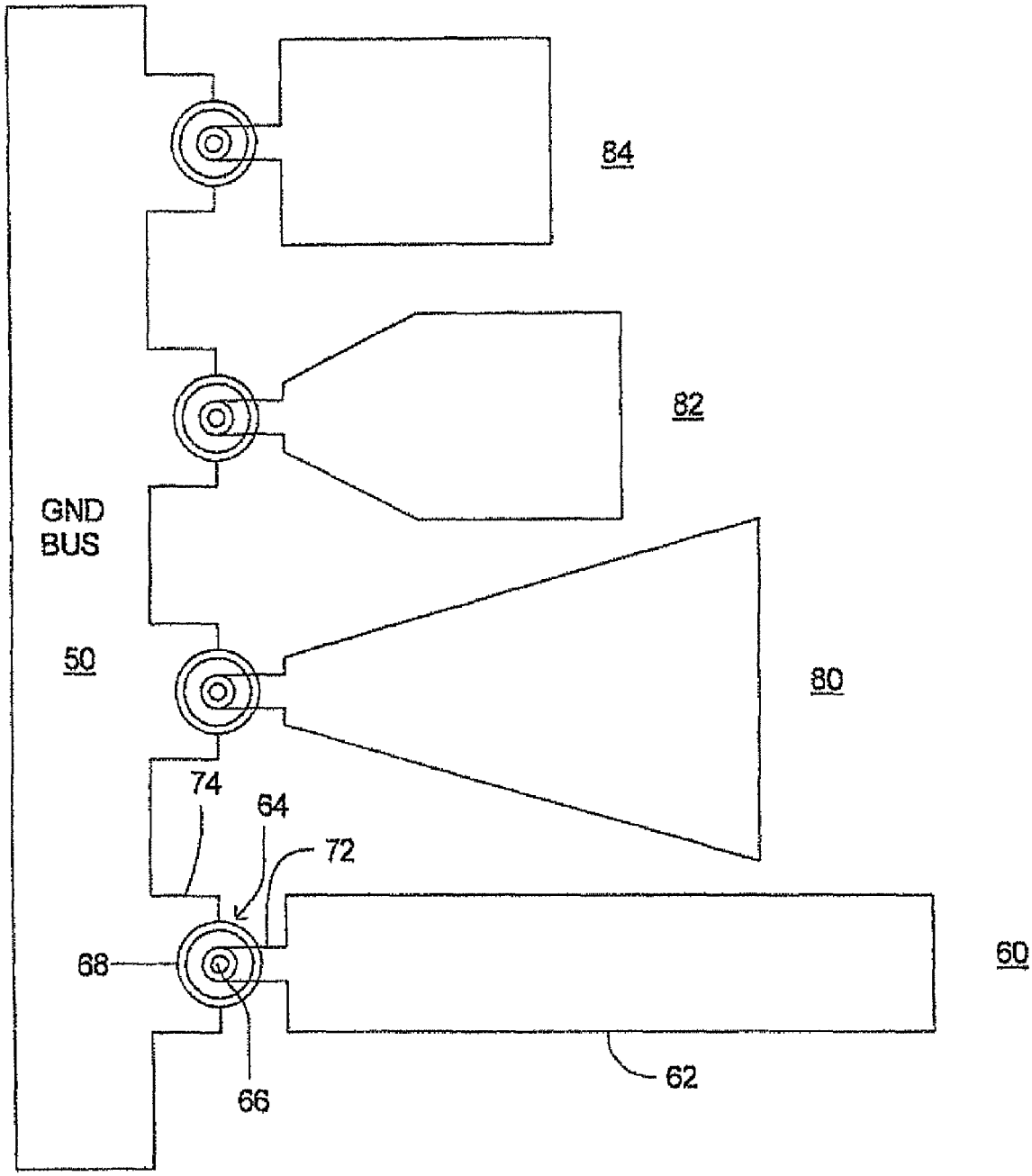
FIG. 4 is a plan view of several antennas as might be used in an embodiment of the antenna system.

In FIG. 4, plural antennas are depicted. These antennas are formed on a planar shaped insulating substrate extending in a principal plane of the plural antennas. Each antenna is formed from conductive material, preferably copper, disposed on an obverse side of the insulating substrate. Antenna 60 includes an antenna radiating element 62 and at least a portion a ground conductor 50 (also referred to as ground bus 50) disposed on the obverse side of the insulating substrate. Antenna 60 further includes a coupler 64 having a first signal conductor 66 and a second signal conductor 68. A feed connects coupler 64 to ground conductor 50 and antenna radiating element 62. In particular, the first signal conductor 66 of the coupler 64 is coupled through a first feed portion 72 to the radiating element 62, and the second signal conductor 68 of the coupler 64 is coupled through a second feed portion 74 to the ground conductor 50.

In operation, applied RF signal currents fed through coupler 64 pass though feed portions 72, 74 into ground bus 50 and radiating element 62. From there, electric fields extend between ground bus 50 and the radiating element 62 in such a way to cause RF signals to radiate from antenna 60.

In alternative embodiments, any one or more of antennas 80, 82 and 84 are similarly formed on the same insulating substrate. Each alternative antenna embodiment is varied by size and shape to meet frequency requirements and impedance matching requirements according to "patch radiator" technology. The size and shape of the feed portions 72, 74 are defined to match impedances from the coupler 64 to the radiating element of the antenna.

Figure 5:
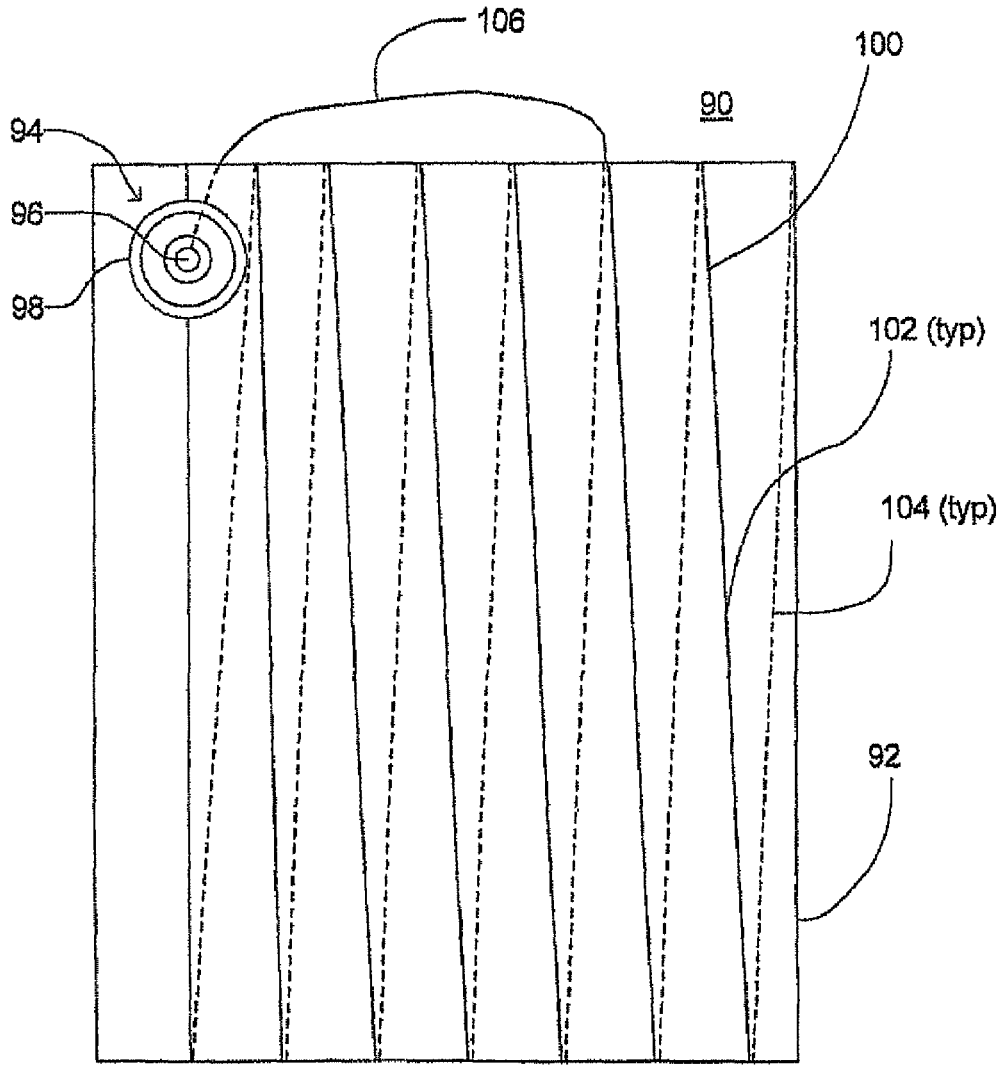
FIG. 5 is a plan view of another antenna as might be used in an embodiment of the antenna system.
Figure 6:
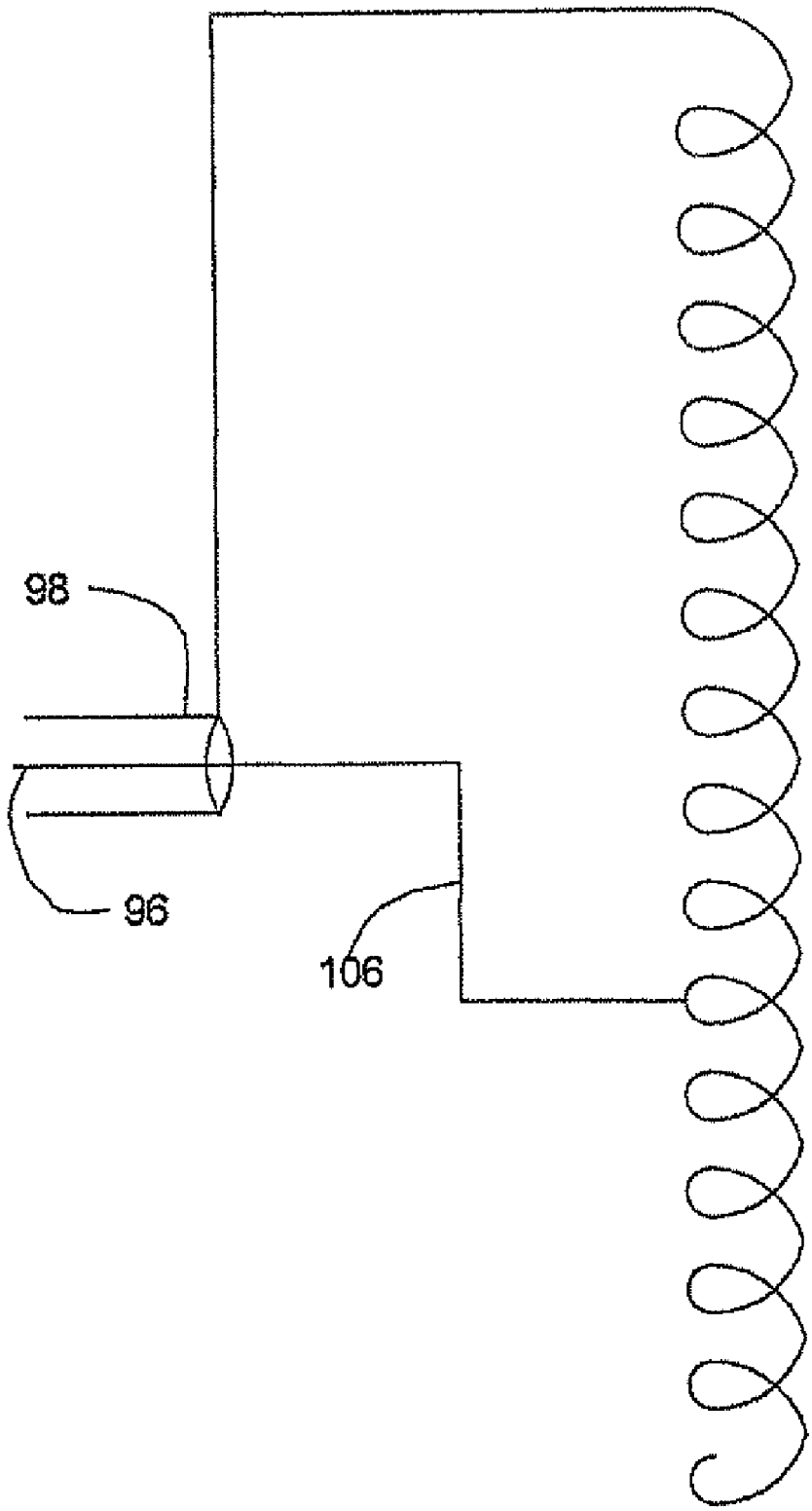
FIG. 6 is a schematic diagram of the antenna of FIG. 5.

In FIGS. 5-6, an antenna 90 includes a planar shaped insulating substrate 92 extending in a principal plane of the antenna. Insulating substrate 92 has an obverse side and a reverse side. Antenna 90 further includes a coupler 94 having a first signal conductor 96 and a second signal conductor 98. Antenna 90 further includes a wire 100 wound in plural turns around the insulating substrate 92. One half of each turn (collectively 102) extends across the obverse side of the substrate, and the other half of each turn (collectively 104) extends across the reverse side of the substrate. In an example of antenna 90, there are 32 turns in the winding. In one example, wire 100 is a wire having a diameter defined by an American Wire Gauge number selected from a range that vary from AWG 18 to AWG 30. If greater current is anticipated, AWG 16 wire might be used. Alternatively, other forms of conductor wires might be used; for example, the wire may be a flat ribbon conductor. The insulating substrate 92 might be an epoxy-glass substrate double clad with copper conductor and etched to form half turns 102 on the obverse side and half turns 104 on the reverse side. The ends of the half turns on the obverse side are connected to the ends of the half turns on the reverse side with plated through holes, rivets, pins or other through conductors as discussed with respect to FIGS. 1-3.

Antenna 90 further includes a tap conductor 106 coupled between the first signal conductor 96 of coupler 94 and a predetermined one of the plural turns of the wire 100. The predetermined turn number is determined during early design stages and may be easily defined by trying several different turn numbers and measuring the antenna's performance. A first end of the plural turns of wire 100 is coupled to the second signal conductor 98.

In operation, applied RF signal currents fed through coupler 94 pass though conductor 96, through tap wire 106 to the predetermined one of the plural turns of wire 100, and from there through a portion of wire 100 to the first end of wire 100 to conductor 98.

Figure 7:
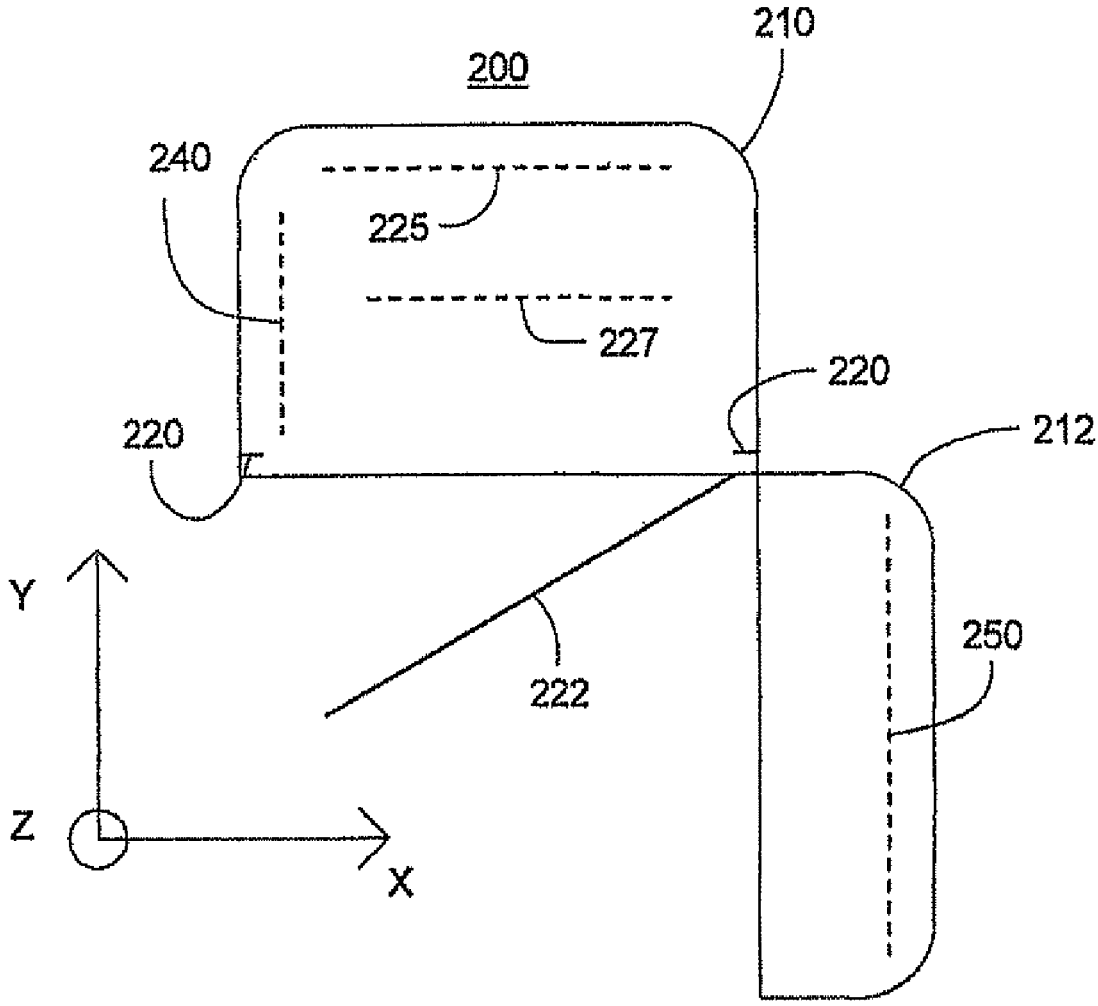
FIGS. 7 and 8 are two orthogonal views of an embodiment of an antenna system.
Figure 8:
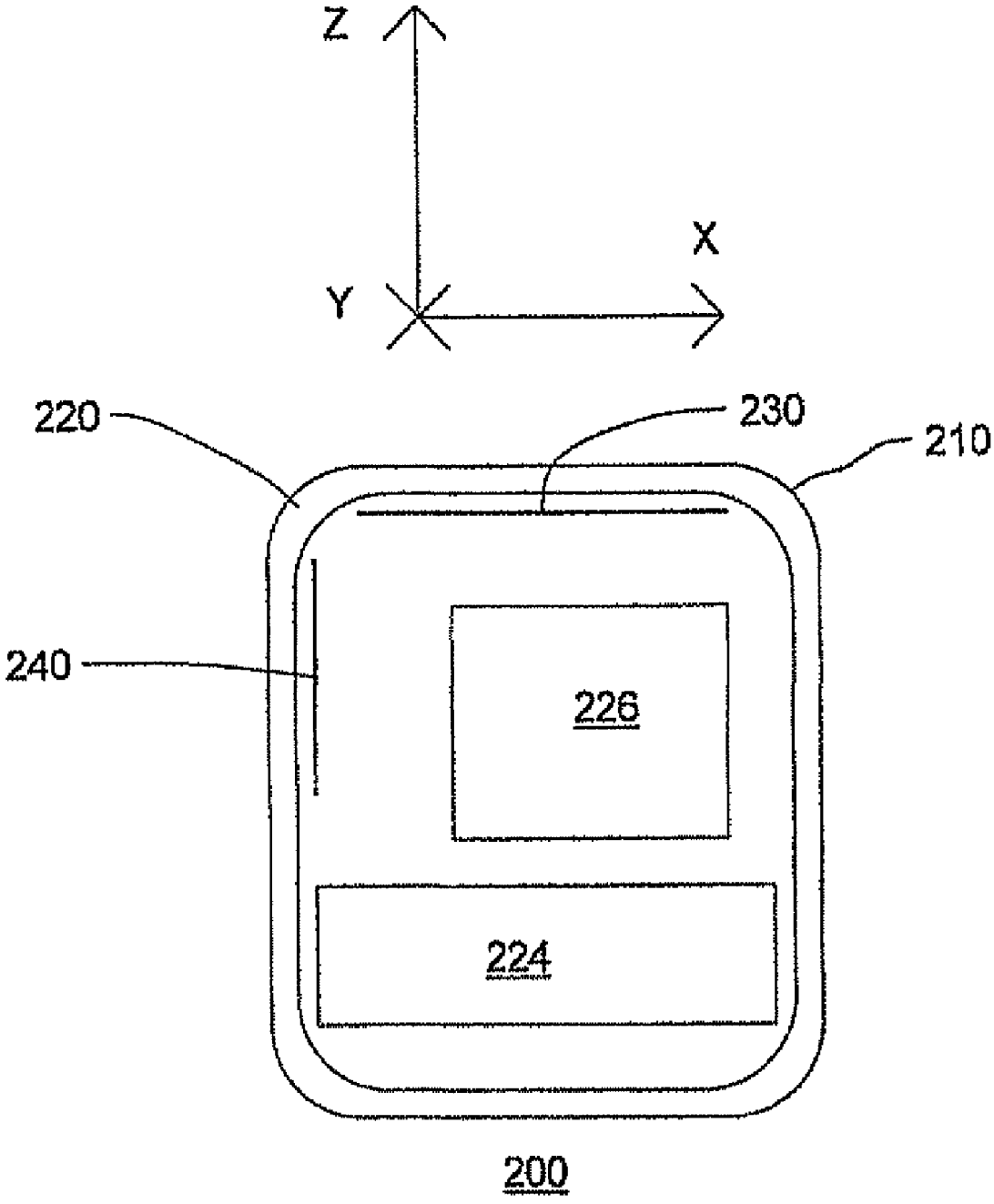

In FIGS. 7-8 an antenna system 200 is depicted. Antennas are mounted within portable case 210 and lid 212. Additionally, conductive control panel 222 is mounted to case 210, preferably by hinges. The case and lid are formed from a non-conductive material such as high impact resistant plastic or rubber. A conductive grounding ring 220 is installed inside the case. Electronic modules 224 and 226 are also installed in the case. Electronic module 224 has an equivalent conductive plane 225, and electronic module 226 has an equivalent conductive plane 227.

The electronic modules may be placed in locations other than those depicted in FIGS. 7 and 8; however, since their equivalent conductive plane may operate as a partial ground plane and reflect RE signals radiated from the antennas, the location of the electronic modules must be taken into account at the time of the design of antenna system 200. Different size, weight, cooling, RF signal and battery power requirements may be imposed on antenna system 200, depending on the application. Therefore, the locations depicted in FIGS. 7 and 8 should be regarded as a starting point and the locations and specific antenna parameters are adjusted to meet imposed requirements.

In a first embodiment of an antenna system, the antenna system includes plural antennas. Each antenna is different than every other antenna, and each antenna is characterized by a principal plane. A principal plane of a first antenna 230 is oblique to a principal plane of a second antenna. The second antenna may be located and oriented as depicted by antenna 240 or 250 in FIGS. 7-8. Much as is described with respect to the antenna depicted in FIGS. 1-3, the first antenna 230 includes a first insulating substrate extending in the principal plane of the first antenna. The first antenna further includes a first radiating element and a connected first conductor and includes a second radiating element and a connected second conductor. The first antenna further includes a coupling conductor coupling the second radiating element and the first conductor. The first antenna further includes a first coupler having a first signal conductor and a second signal conductor. The first signal conductor is coupled to the second conductor, and the second signal conductor is coupled to the first radiating element. The first antenna 230 is not shown in FIG. 7 for clarity, but FIG. 8 depicts an end view of the first antenna 230. The principal plane of the first antenna 230 extends in the X and Y directions. The principal planes of the first and second antennas are oblique; however, in some variants, the planes are substantially orthogonal.

In a first variant of the first embodiment of the antenna system, the second antenna is located and oriented as antenna 240 in FIGS. 7-8. Much as is described with respect to the antenna depicted in FIG. 4, second antenna 240 includes a second insulating substrate extending in the principal plane of the second antenna. The second antenna further includes a second antenna radiating element, a ground conductor, a second coupler and a feed. The second coupler includes a first signal conductor and a second signal conductor. he first signal conductor of the second coupler is coupled to the second antenna radiating element, and the second signal conductor of the second coupler is coupled to the ground conductor. The principal plane of the second antenna 240 extends in the Z and Y directions.

In an example of the first variant of the first embodiment of the antenna system and much as is described with respect to the antenna depicted in FIG. 5, the plural antennas further include a third antenna, and the third antenna 250 includes a third insulating substrate extending in a principal plane of the third antenna. The third antenna further includes a third coupler having first and second signal conductors. The third antenna further includes a wire wound in plural turns around the third insulating substrate and having a first end coupled to the second signal conductor. The third antenna further includes a tap conductor coupled between the first signal conductor and a predetermined one of the plural turns of the wire. The principal plane of the third antenna 250 extends in the Z and Y directions.

In a first mechanization, the principal planes of the first and third antennas 230, 250 are oblique; and possibly substantially orthogonal.

In an example of the first mechanization, the principal planes of the second and third antennas 240, 250 are substantially parallel.

In a second mechanization, the principal planes of the second and third antennas 240, 250 are substantially parallel.

In a second variant of the first embodiment of the antenna system, the second antenna is located and oriented as antenna 250 in FIGS. 7-8. Much as is described with respect to the antenna depicted in FIG. 5, second antenna 250 includes a planar shaped second insulating substrate extending in the principal plane of the second antenna. The second antenna further includes a second coupler having first and second signal conductors. The second antenna further includes a wire wound in plural turns around the second insulating substrate and having a first end coupled to the second signal conductor. The second antenna further includes a tap conductor coupled between the first signal conductor and a predetermined one of the plural turns of the wire. The principal plane of the second antenna 250 extends in the Z and Y directions.

In a second embodiment of an antenna system, the antenna system includes plural antennas. Each antenna is different than every other antenna, and each antenna is characterized by a principal plane. A principal plane of a first antenna is substantially parallel to a principal plane of a second antenna 240. Much as is described with respect to the antenna depicted in FIG. 4, the second antenna 240 includes a planar shaped insulating substrate extending in the principal plane of the second antenna and having an obverse side. The second antenna further includes a radiating element and a ground conductor disposed on the obverse side, a coupler having first and second signal conductors and a feed disposed on the obverse side. The first signal conductor is coupled to the radiating element, and the second signal conductor is coupled to the ground conductor.

In a first variant of the second embodiment of the antenna system, the first antenna is located and oriented as antenna 250 in FIGS. 7-8. Much as is described with respect to the antenna depicted in FIG. 5, first antenna 250 includes a planar shaped first insulating substrate extending in the principal plane of the first antenna. The first antenna further includes a first coupler having first and second signal conductors. The first antenna further includes a wire wound in plural turns around the first insulating substrate and having a first end coupled to the first signal conductor. The first antenna further includes a tap conductor coupled between the second signal conductor and a predetermined one of the plural turns of the wire.

In a third embodiment of an antenna system, the antenna system includes plural antennas. Each antenna is different than every other antenna, and each antenna is characterized by a principal plane. A principal plane of a first antenna 250 is oblique to a principal plane of a second antenna. The second antenna may be located and oriented as depicted by antenna 230 in FIGS. 7-8 or other locations. Much as is described with respect to the antenna depicted in FIG. 5, the first antenna 250 includes a first insulating substrate extending in a principal plane of the first antenna. The first antenna further includes a first coupler having first and second signal conductors. The first antenna further includes a wire wound in plural turns around the first insulating substrate and having a first end coupled to the first signal conductor. The first antenna further includes a tap conductor coupled between the second signal conductor and a predetermined one of the plural turns of the wire.

In many variants of the above embodiments, antennas designed substantially similarly to the antenna depicted in FIGS. 1-3, are designed to operate near resonance over a frequency range from 400 MHz to 500 MHz. This band covers an important FRS band at 462 MHz and another band at 434 MHz.

In many variants of the above embodiments, antennas designed substantially similarly to the antenna depicted at 60 in FIG. 4, are designed to operate near resonance over a frequency range from 462 MHz to 474 MHz. This band covers an important FRS band at 462 MHz and another band at 474 MHz.

In many variants of the above embodiments, antennas designed substantially similarly to the antenna depicted at 80 in FIG. 4, are designed to operate near resonance over a frequency range from 1,800 MHz to 1,900 MHz. This band covers important cell phone bands.

In many variants of the above embodiments, antennas designed substantially similarly to the antenna depicted at 82 in FIG. 4, are designed to operate near resonance over a frequency range from 800 MHz to 900 MHz. This band covers important cell phone bands.

In many variants of the above embodiments, antennas designed substantially similarly to the antenna depicted at 84 in FIG. 4, are designed to operate near resonance over a frequency range from 2,400 MHz to 2,500 MHz. This band covers important cell phone bands.

In many variants of the above embodiments, antennas designed substantially similarly to the antenna depicted in FIG. 5, are designed to operate near resonance over a frequency range from 25 MHz to 200 MHz. This band covers an important data links at 27 MHz and 134 MHz to 138 MHz.

In a jammer operation, the antennas are fed by signal oscillators. While known broadband jammers require noise generators, with the present invention, inexpensive oscillators may be used. It should be noted that spectral purity of the oscillator is not a requirement. Waveforms distorted from pure sinusoidal waveforms merely add to the broadband coverage. The several antennas, located in the near radiation field (i.e., within 5 to 10 wavelengths) from each other, add to the distortion giving rise to a broadband effect. Signals radiated from one antenna excite parasitic resonance in other nearby antennas. The oscillators for a frequency range from 400 MHz to 500 MHz, for a frequency range from 800 MHz to 900 MHz, for a frequency range from 1,800 MHz to 1,900 MHz, and for a frequency range from 2,400 MHz to 2,500 MHz are located in electronic module 226 of FIG. 8. The oscillators for a frequency range from 25 MHz to 200 MHz and for 300 MHz to 500 MHz are located in electronic module 224. Other locations may be equivalent, but the system performance must be checked to ensure proper performance.

The overall antenna system is intended to work with the oscillators to disrupt communications in selected bands. When considering design balancing, the need for portable operation and long battery life gives rise to a need for low transmit power. However, high transmit power is generally needed to jam a data link. Long battery life is best achieved by ensuring that the radiation intensity pattern is efficiently used. Coverage for the system described is intended to be omni directional in three dimensions. Thus, the best antenna pattern is achieved when there are no main lobes with great antenna gain and no notches with below normal antenna gain. For at least this reason, placement of the antennas and all conductive elements (e.g., electronic modules 224 and 226) are very important, a requirement that become all the more difficult when another requirement of broadband jamming is required in selected bands.

Figure 9:
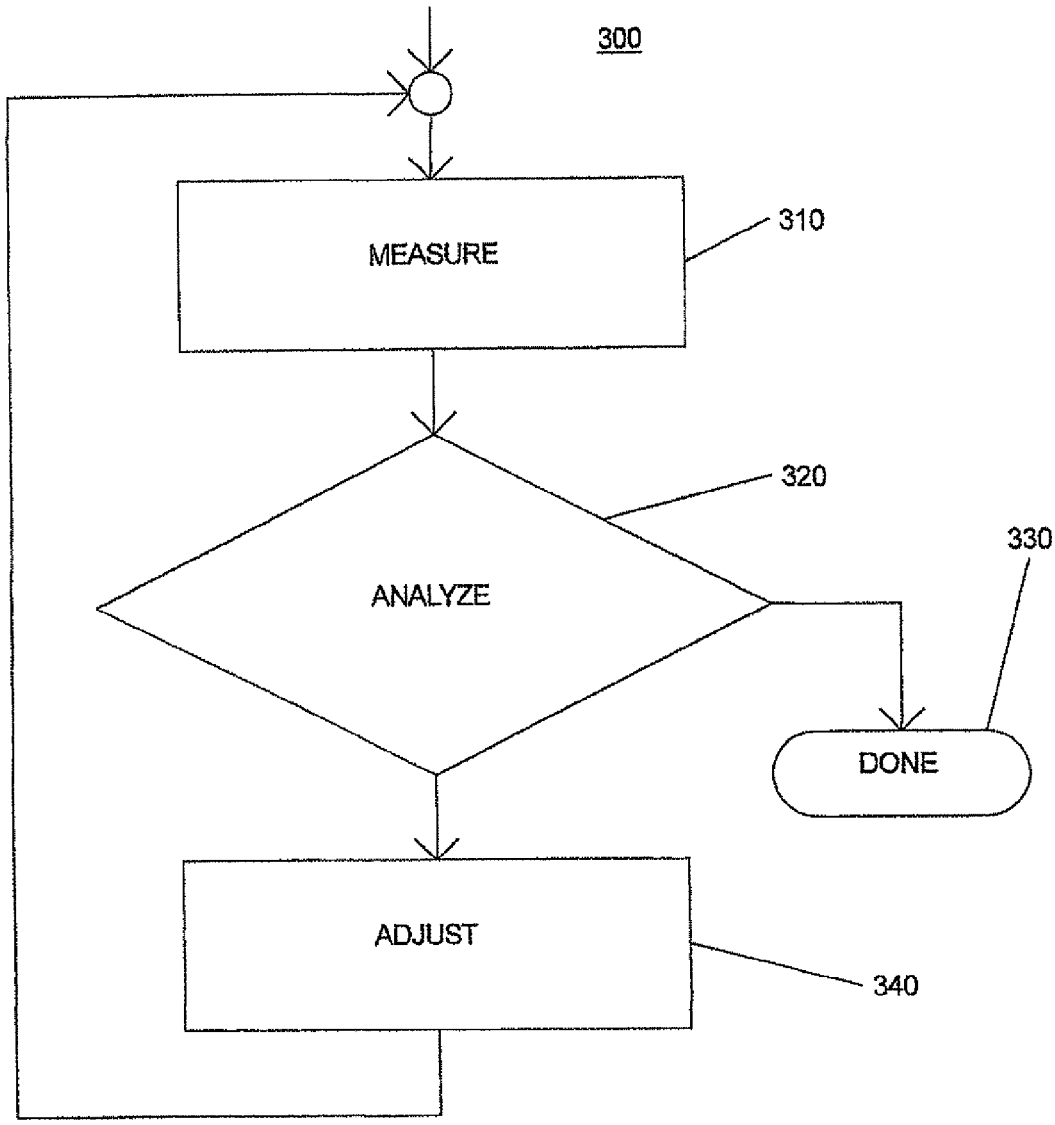
FIG. 9 is a flow chart of an embodiment of a process to tune an antenna system.

To meet these stringent requirements, the design process 300 includes measuring performance, analyzing the results and adjusting the antennas' location, orientation and individual antenna design. In FIG. 9, the performance is measured at 310. The performance is measured in terms of antenna gain at angular intervals over an entire unit sphere. At each angular measurement point, the gain is measured at each frequency of interest for the design. The measured performance is analyzed at 320. If the gain is adequate at each angular position and at each frequency of interest, then the design is correctly adjusted and the design process is done at 330. If the performance is inadequate at either a spatial point or at a spectral point (i.e., a frequency point), then the design is adjusted at 340.

Figure 10:
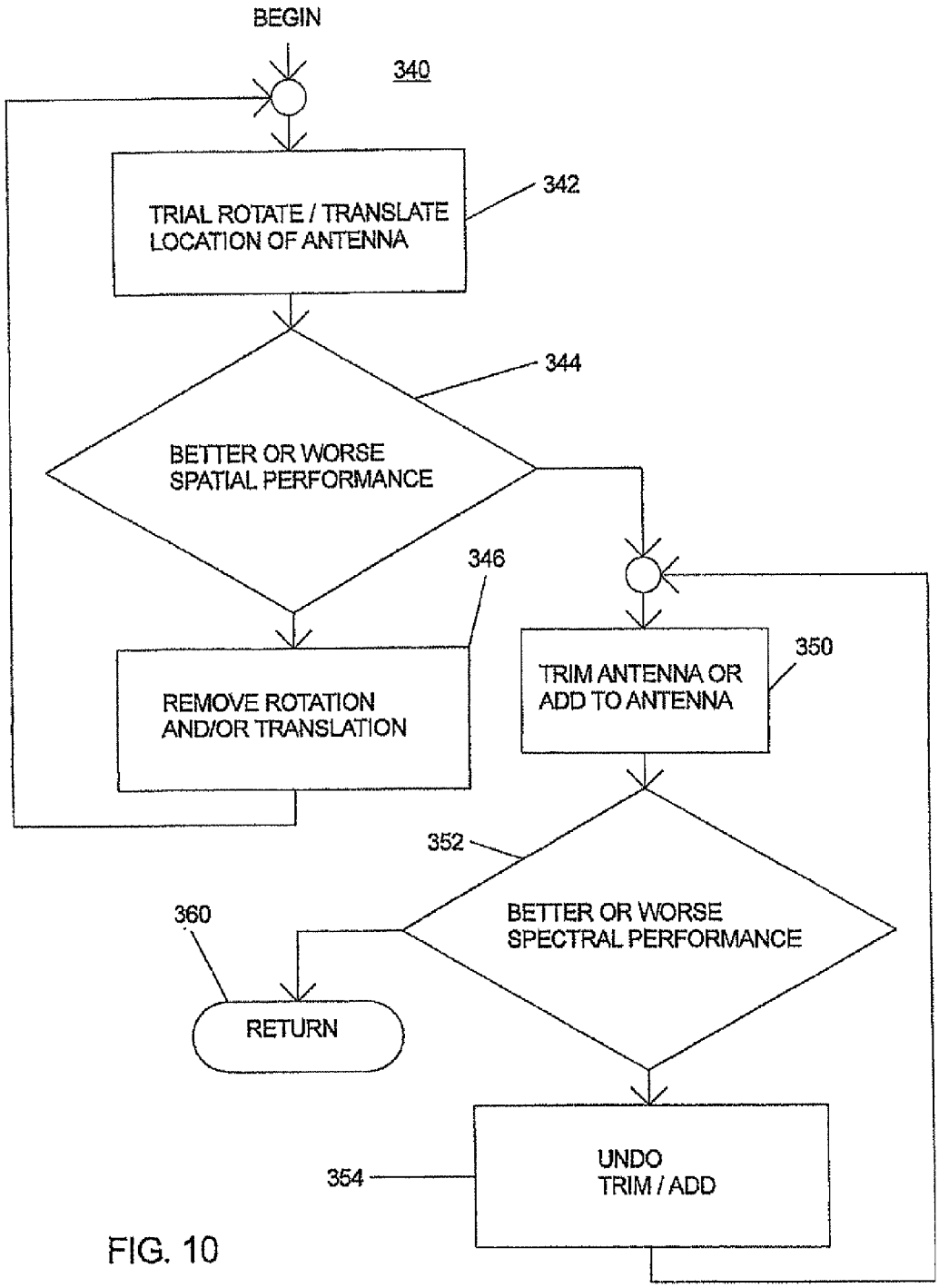
FIG. 10 is a flow chart of an embodiment of the adjust process of FIG. 9.

In FIG. 10, the design adjustment process 340 is depicted. If the gain is inadequate at a spatial point, a trial relocation or rotation of an antenna is attempted 342. The performance is measured and a decision is made at 344 as to whether the spatial performance (i.e., antenna pattern) is better or worse. If the spatial performance is worse, the rotation and/or translation is removed at 346 and a new try is made at 342. In this instance, better means that the spatial performance at one required frequency is met. If the performance is better as tested at 344, then the antennas are adjusted. Beginning with the antenna that has the best performance as measured by gain uniformity over the frequency band, the antenna is adjusted at 350 by trimming the size of the antenna or adding to the size of the antenna. Typically, this is done by trimming a copper clad epoxy-glass substrate with a sharp knife or by adding conductive foil to extend the size of the antenna. This process may be guided by known antenna design techniques. Once adjusted, the antenna is tested for spectral uniformity at 352, and if the uniformity requirement is not yet met, the trim/add is undone at 354 and the adjusting of the antenna is done again. After one antenna is adjusted, the next antenna in the antenna system is similarly adjusted until all antennas provide a suitable uniform spectral response, at which time, the adjustment process 340 is done at 360.

In FIG. 9, after the adjustment process 340 is completed a new measurement is made at 310 and analyzed at 320. This process is repeated until done at 330.

Figure 11:
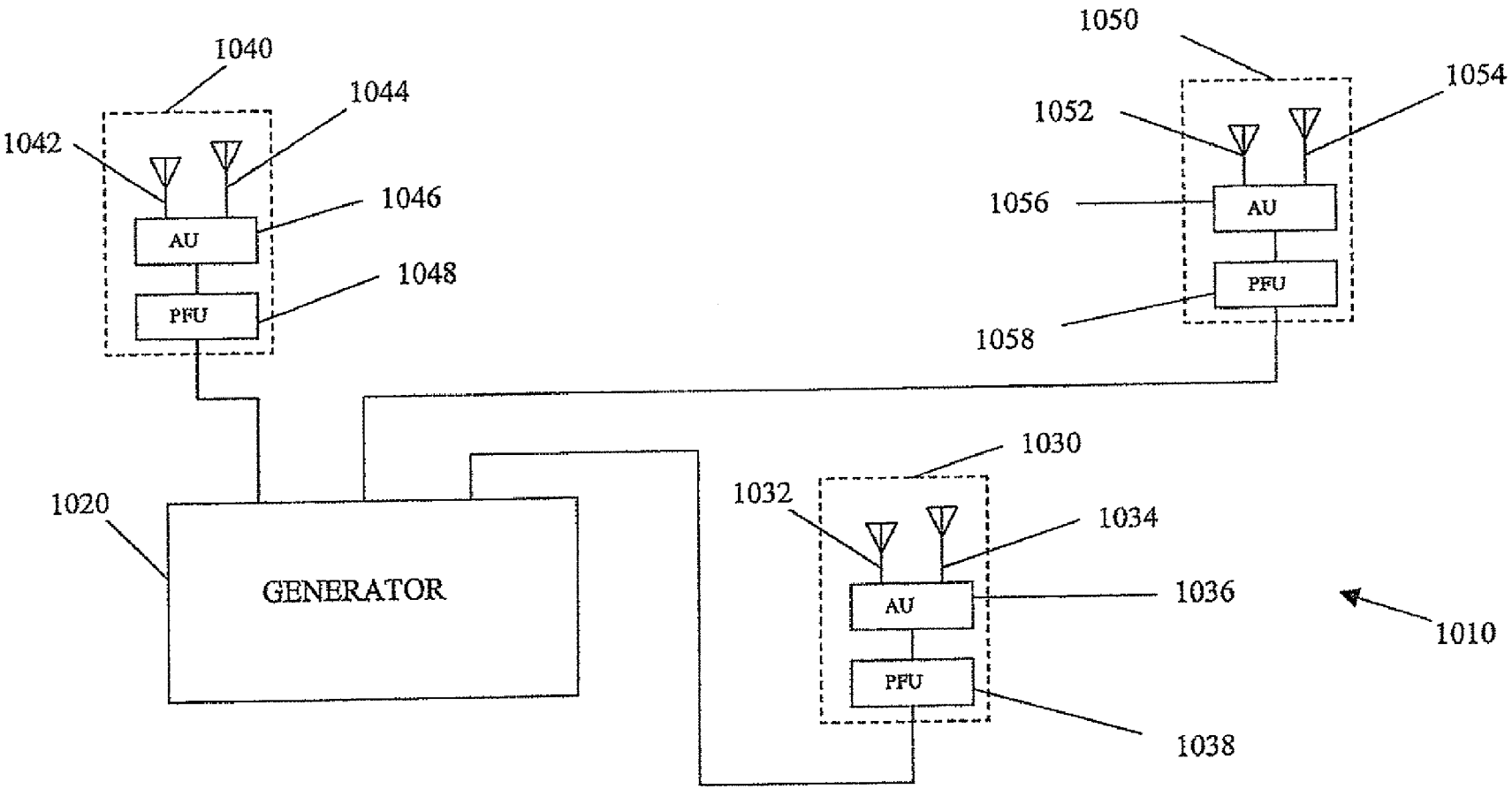
FIG. 11 is a block diagram of a jamming system.

A first embodiment of a central integrated jamming system is depicted in FIG. 11, where a system 1010 includes a generator 1020 and at least three devices 1030, 1040 and 1050 located at vertices of an area to be protected. A first device 1030 includes a receive antenna 1032, a transmit antenna 1034, an antenna unit 1036 and a programmable feed unit 1038 coupled between antenna unit 1036 and generator 1020. A second device 1040 is similarly configured, and a third device 1050 is similarly configured. In each device, a signal received at the receive antenna is amplified and broadcasted from the transmit antenna so that the device itself oscillates and produces a random noise signal. In an alternative embodiment of the invention, the system further includes a fourth device also configured at a vertex of the area to be protected.

Figure 12:
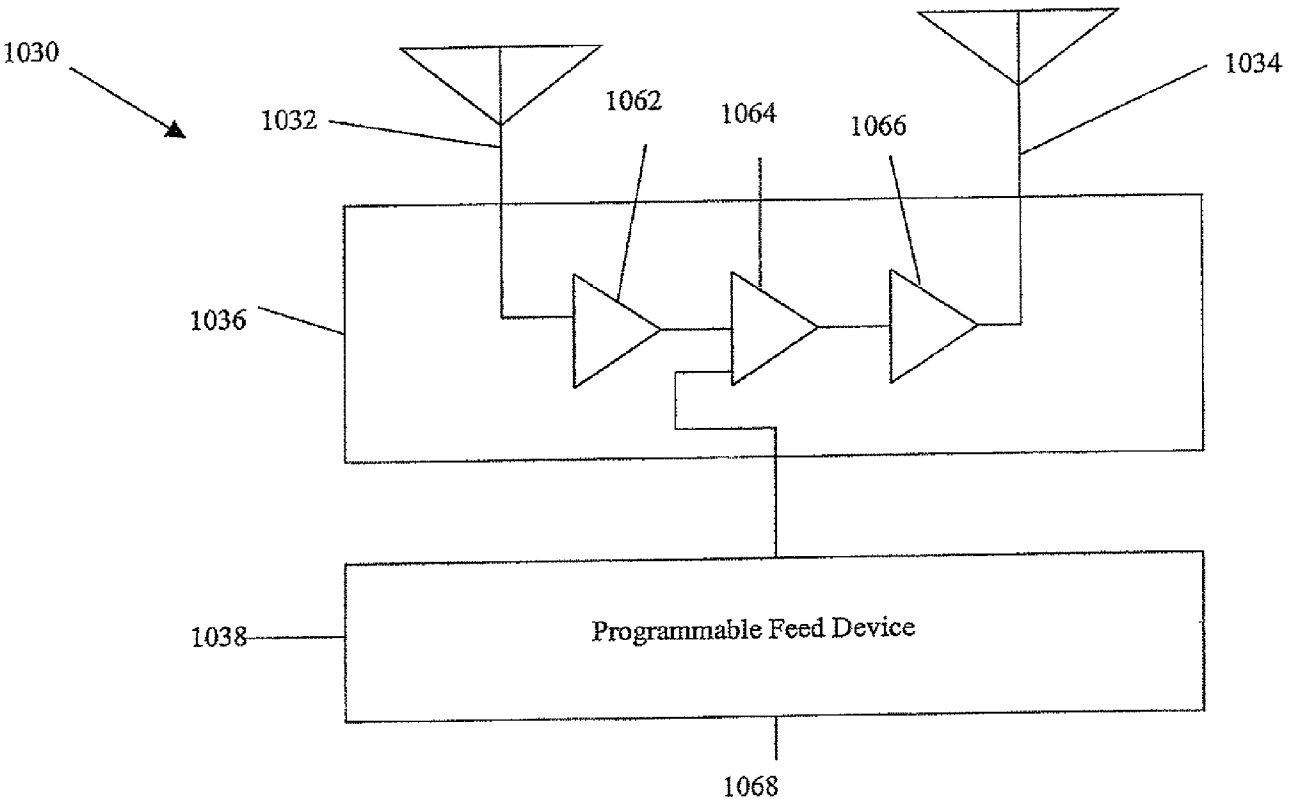
FIG. 12 is a block diagram of a device showing details of an antenna unit.

In a variant of the first embodiment and as depicted in FIG. 12, each antenna unit 1036, 1046 and 1056 in each device 1030, 1040 and 1050 includes a receiver 1062 coupled to the respective receive antenna, a controllable amplifier 1064 coupled to the respective receiver and also coupled to the respective programmable feed unit 1038, 1048 and 1058, and a transmitter 1066 coupled between the respective amplifier and the respective transmit antenna 1034, 1044 and 1054. As discussed below, signal 1068 is provided by generator 1020 to the programmable feed unit, and signal 1068 includes:

1. a noisy signal from generator 1020 to the programmable feed unit;
2. a signal to control phase shifting of the noisy signal in the programmable feed unit; and
3. a signal to control attenuation of the noisy signal in the programmable feed unit.

The phase shifted and/or attenuated version of the noisy signal is then provided by the programmable feed unit to control the controllable amplifier 1064 in the receiver unit. This ensures random noise is produced from the transmit antenna.

In operation, each device tends to oscillate on its own. A signal from the transmit antenna is picked up on the receive antenna. The signal picked up on the receive antenna is received in receiver 1062, amplified in amplifier 1064 and provided to transmitter 1066 that is coupled the respective transmit antenna. When this loop provides enough gain, the device will oscillate. In fact, the proximity of the antennas helps ensure that the loop will have enough gain. Amplifier 1064 may well provide fractional amplification or operate as an attenuator. This loop is adjusted to have a loop gain from just below oscillation to just above oscillation when operated on its own. The receive antenna will pick up additional signals from other transmit antennas in system 1010 and from reflections off nearby reflective surfaces. In addition, signals from the respective programmable feed device 1038, 1048 or 1058, as discussed herein, are added into the loop at amplifier 1064. The loop gain is adjusted to oscillate with a random noisy waveform in this environment.

In another variant of the first embodiment, either the transmit antenna or the receive antenna, or both, of first device 1030 is a directional antenna directed toward a point inside the area to be protected, either the transmit antenna or the receive antenna, or both, of second device 1040 is a directional antenna directed toward the point inside the area to be protected, and either the transmit antenna and the receive antenna, or both, of third device 1050 is a directional antenna directed toward the point inside the area to be protected. In operation, directing antenna gain inside the area to be protected tends to minimize collateral jamming effects outside of the desired area to be protected, and tends to minimize the power required from transmit antennas 1034, 1044 and 1054 to achieve the desired level of jamming inside the area to be protected.

In another variant, the devices 1030, 1040 and 1050 are located near a reflective surface or reflective surfaces that are characterized by a curvature. This produces reflected signals that appear to come from conjugate images of the transmit antennas of the devices.

In yet another variant, the devices 1030, 1040 and 1050 are located near a reflective surface or reflective surfaces that are characterized by a curvature. The reflective surface includes any or all of the inside walls of an aircraft, the inside walls of a railroad car, the inside walls of bus, the walls of a subway tunnel, the walls of an automobile tunnel, and the walls of an auditorium, conference room, studio or the link. This also produces reflected signals that appear to come from conjugate images of the transmit antennas of the devices within the aircraft, the railroad car, the bus, the subway tunnel, the automobile tunnel, or the auditorium.

In another variant of the first embodiment, the generator produces a signal that is characterized by a center frequency. The generator includes a comb generator with a bandwidth greater than 20% of the center frequency and preferably grater than 50% of the center frequency. In practical systems, jamming of signals at frequencies of 312, 314, 316, 392, 398, 430, 433, 434 and 450 to 500 MHz may be desired. A center frequency of 400 MHz and a jamming bandwidth of 200 MHz (307 MHz to 507 MHz, a 50%© bandwidth) would cover this range. A very suitable system for some application may be realized by jamming 430 through 500 MHz (a 20% bandwidth centered on 460 MHz). The frequency band from 312 through 316 MHz may be easily covered by a 2% bandwidth generator, and the 392 and 398 MHz frequencies may be easily covered by a generator with just a little more than 2% bandwidth.

In another variant of the first embodiment, the programmable feed unit in each device includes either a programmable attenuator coupled to the generator, a programmable phase shifter coupled to the generator, or both. In a version of this variant, where the programmable feed unit in each device includes the programmable attenuator, the programmable attenuator includes a variable gain amplifier characterized by a gain controlled by a signal from the generator. In another version of this variant, where the programmable feed unit in each device includes the programmable phase shifter, the programmable phase shifter may be mechanized with several designs.

In one design, the programmable phase shifter includes a network that includes a variable inductor where an inductance of the inductor is controlled by a signal from the generator. An example of such a variable inductor is a saturable inductor. A saturable inductor includes two coils wound around a common magnetic material such as a ferrite core. Through one coil, a bias current passes to bring the ferrite core in and out of saturation. The other coil is the inductor whose inductance is varied according to the bias current. The bias current is generated in generator 1020, and it may be either a fix bias to set the phase shifting property or it may be a pulsed waveform to vary the phase shifting property.

In another design, the programmable phase shifter includes a network that includes a variable capacitor where a capacitance of the capacitor is controlled by a signal from the generator. A back biased varactor diode is an example of such a variable capacitor.

In yet another design, the programmable phase shifter includes a variable delay line where a delay of the delay line is controlled by a signal from the generator. A typical example of this type of delay line at microwave frequencies is a strip line disposed between blocks of ferrite material where the blocks of ferrite material are encircled by coils carrying a bias current so that the ferrite materials are subjected to a magnetizing force. In this way, the propagation properties of strip line are varied according to the magnetizing force imposed by the current through the coil.

In yet another design, the programmable phase shifter includes two or more delay lines, each characterized by a different delay. The phase shifter further includes a switch to select an active delay line, from among the two or more delay lines, according to a signal from the generator.

Whatever the design that is used, the bias current or control signal is generated in generator 1020. It may be either a fixed voltage or current to set the phase shifting property of the programmable feed unit or it may be a pulsed waveform to vary the phase shifting property.

In another variant of the first embodiment, generator 1020 is processor controlled. The processor may be a microprocessor or other processor. A memory stores the modes of operations in the form of a threat table that specifies such parameters as the center frequency and the bandwidth of the signals to be generated by generator 1020 for each threat or application (e.g., tunnel, aircraft, railroad car, office auditorium, etc.) and stores the attenuation and phase shifting properties to be provided to each of the programmable feed units 1038, 1048 and 1058. In a typical generator design, the threat table provides a center frequency for a radio frequency jamming signal and also proved a seed for a random number generator (e.g., digital key stream generator). The random numbers are used to generate a randomly chopped binary output waveform at about 5 to 20 times the center frequency that used as a chopping signal to modulate the signal at the center frequency. Many other types of noise generators may also be used. The output of the chopped center frequency signal is a broadband noise signal that is provided to each of the programmable feed units 1038, 1048 and 1058.

In alternative variants, generator 1020 includes circuits to generate additional randomly chopped binary output waveforms, according to parameters in the threat table, to control the variable attenuator and/or the variable phase shifter in each of the programmable feed units 1038, 1048 and 1058. Alternatively, the threat table may store a fixed number, for each threat, to provide a fixed attenuation and a fixed phase shift in the programmable feed units 1038, 1048 and 1058 that may be selected differently for each threat.

The above described central integrated jamming system is partitioned into three separate jamming units. The first jamming unit covers a low band at selected frequencies, for example, from about 20 MHz to 200 MHz and 462 MHz to 468 MHz, or any band into which it is desired to send a higher level of concentrated jamming power. The second jamming unit broadly covers the low band, for example, from 3 MHz to 500 MHz to jam frequencies that do not require the specific concentration of jamming power. The third jamming unit broadly covers a high band, for example, 0.7 GHz to 3 GHz, or other band into which it is desired to jam.

These three repackaged units are not identical, but instead cover their respective assigned bands. Nevertheless, signals from the all three jamming units inject RF power into the target to be jammed. Additionally, harmonic signals associated with the radiated RF signals from each of the individual jamming units interact with the RF signals radiated from the other jamming units, even though out of band, so as to be additive as nonlinear signal distortions directed into the target to be jammed. In this way, nonlinear distortions in the output signals are enhanced which contributes further to the randomness of the jamming and avoids nulls in coverage.

In a preferable embodiment, the three repackaged jamming units are desired to be compatible with use, i.e. carried in, a man pack. For purposes of this specification, portable as applied to the partitioned jamming units will be defined without limiting the scope of the invention as "man-packable", meaning having a weight that is sufficiently low to be able to be carried with relative ease by a person or soldier in addition to his other equipment, i.e. preferably less than 4 kilograms plus battery weight. Further, the radiated power is preferably limited to 10 watts, and more preferably to only 7 or 8 watts. A CINGARS battery is one of the most available battery types on modern battlefield, and the limitation of less than 10 watts radiated power, permits adequate operating time using a standard CINGARS battery. The weight limit of 3 or 4 kilograms plus the weight of a CINGARS battery is compatible with man pack use.

This restriction on weight and power is also compatible with splitting the integrated jamming system into the three jamming units discussed above. Even though, each of the jamming units provides different frequency coverage, the radiated power is such that a jamming unit's sphere of coverage overlaps, at a significant power level, the spheres of coverage of the other two jamming unit when operated in accordance with the method of using the distributed jamming system.

The inventor herein has discovered that sufficient spatial overlap of the respective spheres of coverage provides sufficient random distortion in the region of operation to jam desired targets. In particular, the inventor has discovered that the random yaw characteristic of an antenna pattern of a jamming unit carried in a man pack where the soldier carrying the man pack is moving, serves to increase the distortion of the total jamming system and prevent nulls and voids. Furthermore, the inventor has discovered that the random "leap frog" positioning of soldiers carrying a jamming unit in a man pack also serves to increase the distortion of the total jamming system and prevent nulls and voids.

For example, for jamming units described above (e.g., 3 to 4 kilograms and less than 10 watts radiated power) might be carried in man packs of soldiers in close quarter combat. Separation of the soldiers in a team might be limited to 2 or 3 meters. The inventor has discovered that the man pack repackaging and use enhances distortion of signals at the target, even though the central integrated jamming system is now dispersed spatially and each dispersed jamming unit covers a different frequency band. The inventor has discovered that even if the man pack jamming units are separated by 50 meters, overlapping spherical coverages of the jamming units are sufficient to provide effective jamming of targets because of the enhanced distortion caused by random yaw of the antenna patterns and/or the "leap frog" tactics of the soldiers when carrying out close combat missions.

A system using such partitioned portable jamming units may be further enhanced by making a unique selection of the frequencies of the individual units, such that the principal harmonics of the different transmitted frequencies align in phase within the 3-dimensional volume being jammed in order to provide additive regenerative jamming effects over and above those associated with just the principal frequencies being transmitted. It can further be appreciated that by dynamically changing the frequencies of the individual units on a continuing basis, random regenerative jamming signals can be generated over broader frequency spectrum due to these same harmonic effects.

In addition to the foregoing spatial effects, which can create a changeable sphere of coverage based on the relative fixed positions of the individual jamming units at any point in time, the present invention further discloses an additional jamming effect due to the relative dynamic motion (i.e. soldier "leap-frog" tactics) of those same jamming units. This additional jamming effect is a result from the interaction of the differently polarized electromagnetic fields moving relative to teach other in real time, thereby creating a "magnetic shearing" effect. Such shearing effect creates additional broadband noise within the 3-dimensional volume, thereby further enhancing the jamming capabilities of the jamming system over that which would normally be expected in static jamming systems.

Having described preferred embodiments of a novel method of jamming (which are intended to be illustrative and not limiting), it is noted that modifications and variations can be made by persons skilled in the art in light of the above teachings. It is therefore to be understood that changes may be made in the particular embodiments of the invention disclosed which are within the scope of the invention as defined by the appended claims.

Having thus described the invention with the details and particularity required by the patent laws, what is claimed and desired protected by Letters Patent is set forth in the appended claims.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding U.S. Provisional Application Ser. No. 60/830,670, filed Jul. 14, 2006, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A method for jamming a band of frequencies within a finite spatial domain using a plurality of portable rf jamming devices, comprising:

positioning a first portable rf signal jamming device at a first location;

positioning a second portable rf signal jamming device at a second location that is physically separated from the first location by a first distance;

positioning at least a third portable rf signal jamming device at a third location that is physically separated from the first and second locations by a second and third distance, respectively;

transmitting a first rf signal in the first portable rf signal jamming device at a first portion of frequency bandwidth from a first transmitter to a first plurality of antennae associated with the first portable rf signal jamming device to produce a first radiation pattern;

transmitting a second rf signal in the second portable rf signal jamming device at a second portion of frequency bandwidth from a second transmitter to a second plurality of antennae associated with the second portable rf signal jamming device to produce a second radiation pattern; and transmitting at least a third rf signal in the third portable rf signal jamming device at a third portion of frequency bandwidth from a third transmitter to a third plurality of antennae associated with the third portable rf signal jamming device to produce a third radiation pattern, the transmitted signals further being characterized such that the combined effect of the impingement of the first, second, and third radiation patterns create a 3-dimensional volume that is jammed over at least the rf frequencies being transmitted.

2. The method according to claim 1, additionally comprising selecting the frequency portions and transmission bandwidths of the first, second and third rf signals of the physically separated first, second and third portable rf signal jamming devices such that a plurality of greater regenerative interference signals are created within the 3-dimensional volume than would result from the first, second, and third rf jamming devices being located at a same location.

3. The method according to claim 2, additionally comprising providing frequency filtering that manipulates a plurality of harmonic frequencies associated with the transmitted frequencies to strengthen the plurality of greater regenerative interference signals.

4. The method according to claim 1, wherein the 3-dimensional volume is physically located between the first, second, and third portable rf signal jamming devices.

5. The method according to claim 1, wherein the 3-dimensional volume created includes the locations of the first, second, and third portable rf signal jamming devices.

6. A system for jamming a band of frequencies within a finite spatial domain, comprising:

a first portable rf signal jamming device positioned at a first location, further comprising a transmitter capable of transmitting a first rf signal at a first portion of frequency bandwidth to a first plurality of antennae to produce a first radiation pattern;

a second portable rf signal jamming device further comprising a transmitter capable of transmitting a second rf signal at a second portion of frequency bandwidth to a second plurality of antennae to produce a second radiation pattern, the second portable rf signal jamming device being positioned at a second location that is physically separated from the first location by a first distance, and;

at least a third portable rf signal jamming device further comprising a transmitter capable of transmitting a third rf signal at a third portion of frequency bandwidth to a third plurality of antennae to produce a third radiation pattern, the third portable rf signal jamming device being positioned at a third location that is physically separated from the first and second locations by a second and third distance, respectively;

the system being further characterized such that the combined effect of the impingement of the first, second and third radiation patterns creates a 3-dimensional volume that is jammed over at least the rf frequencies being transmitted.

7. The system according to claim 6, additionally being characterized by the unique selection of the frequency portions and transmission bandwidths of the first, second and third rf signals of the physically separated first, second and third portable rf signal jamming devices such that a plurality of greater regenerative interference signals are created within the 3-dimensional volume than would result from the first, second, and third rf jamming devices being located at a same location.

8. The system according to claim 6, further comprising at least a first frequency filter for manipulating a plurality of harmonic frequencies associated with the first rf signal in order to strengthen the plurality of greater regenerative interference signals.

9. The system according to claim 6, wherein the first, second, and third radiation patterns are polarized in differing orientations.

10. A method for jamming a band of frequencies within a finite spatial domain using a partitioned plurality of portable rf jamming devices, comprising the steps of positioning a first portable rf signal jamming device at a first location;

positioning a second portable rf signal jamming device at a second location that is physically separated from the first location by a first distance;

positioning at least a third portable rf signal jamming device at a third location that is physically separated from the first and second locations by a second and third distance, respectively;

transmitting a first rf signal in the first rf signal jamming device at a first portion of frequency bandwidth from a first transmitter to a first plurality of antennae associated with the first rf signal jamming device to produce a first radiation pattern;

transmitting a second rf signal in the second portable rf signal jamming device at a second portion of frequency bandwidth from a second transmitter to a second plurality of antennae associated with the second portable rf signal jamming device to produce a second radiation pattern; and transmitting at least a third rf signal in the third portable rf signal jamming device at a third portion of frequency bandwidth from a third transmitter to a third plurality of antennae associated with the third portable rf signal jamming device to produce a third radiation pattern, the transmitted signals further being characterized such that the combined effect of the impingement of the first, second, and third radiation patterns create a 3-dimensional volume that is jammed over at least the rf frequencies being transmitted; and moving at least one of the plurality of portable rf jamming devices, such that the motion of the one portable rf jamming device relative to the others of the plurality of portable rf jamming devices creates a shearing effect in a composite magnetic flux pattern in the 3-dimensional volume, thereby generating additional interference signals within the 3-dimensional volume.

11. The method according to claim 10, additionally comprising selecting the frequency portions and transmission bandwidths of the first, second and third rf signals of the physically separated first, second and third portable rf signal jamming devices such that a plurality of greater regenerative interference signals are created within the 3-dimensional volume than would result from the first, second, and third portable rf jamming devices being located at a same location.

12. The method according to claim 11, additionally comprising providing frequency filtering that manipulates a plurality of harmonic frequencies associated with the transmitted frequencies to strengthen the plurality of greater regenerative interference signals.

13. The method according to claim 10, wherein the 3-dimensional volume is physically located between the first, second, and third portable rf signal jamming devices.

14. The method according to claim 10, wherein the 3-dimensional volume created includes the locations of the first, second, and third portable if signal jamming devices.

15. A system for jamming a band of frequencies within a finite spatial domain, comprising:

a first portable rf signal jamming device positioned at a first location, further comprising a transmitter capable of transmitting a first rf signal at a first portion of frequency bandwidth to a first plurality of antennae to produce a first radiation pattern;

a second portable if signal jamming device further comprising a transmitter capable of transmitting a second rf signal at a second portion of frequency bandwidth to a second plurality of antennae to produce a second radiation pattern, the second portable rf signal jamming device being positioned at a second location that is physically separated from the first location by a first distance, and;

at least a third portable rf signal jamming device further comprising a transmitter capable of transmitting a third rf signal at a third portion of frequency bandwidth to a third plurality of antennae to produce a third radiation pattern, the third portable rf signal jamming device being positioned at a third location that is physically separated from, and in continuous relative motion to, the first and second locations by a second and third distance, respectively;

the system being further characterized such that the combined effect of the impingement of the first, second and third radiation patterns creates a 3-dimensional volume that is jammed over at least the if frequencies being transmitted.

16. The system according to claim 15, additionally being characterized by the unique selection of the frequency portions and transmission bandwidths of the first, second and third rf signals of the physically separated first, second and third portable if signal jamming devices such that a plurality of greater regenerative interference signals are created within the 3-dimensional volume than would result from the first, second, and third rf jamming devices being located at a same location.

17. The system according to claim 15, further comprising at least a first frequency filter for manipulating a plurality of harmonic frequencies associated with the first rf signal in order to strengthen the plurality of greater regenerative interference signals.

18. The system according to claim 15, wherein the first, second, and third radiation patterns are polarized in differing orientations.

19. The system according to claim 18, wherein at least one of the first, second, and third radiation patterns are continuously changing the radiation orientations relative to the other two radiation patterns.

20. A method of using three or more jamming units, each jamming unit being separately positionable and pointable, each jamming unit covering a different frequency bands, the method comprising:

moving a first jamming unit relative to a second jamming unit; and yawing a first jamming unit relative to an orientation of a third jamming unit.

* * * * *